US005131569A

United States Patent [19]

Hodgson

[11] Patent Number: 5,131,569

[45] Date of Patent: Jul. 21, 1992

[54] AEROSOL TYPE CONTAINER

[76] Inventor: Donald E. Hodgson, 9081 Tahoe La., Boulder, Colo. 80301

[21] Appl. No.: 655,538

[22] Filed: Feb. 14, 1991

[51] Int. Cl.[5] ..... B67D 5/378

[52] U.S. Cl. ..... 222/153; 222/400.8; 222/401; 239/337

[58] Field of Search ..... 222/153, 400.8, 401; 239/337

[56] References Cited

U.S. PATENT DOCUMENTS

| | | | |
|---|---|---|---|
| 4,203,532 | 5/1990 | Mar | 222/153 |
| 4,341,330 | 7/1982 | Mascia et al. | 222/401 |
| 4,436,227 | 3/1984 | Johnson, Jr. et al. | 222/400.8 X |
| 4,537,334 | 8/1985 | Spengler et al. | 222/401 |
| 4,957,218 | 9/1990 | Ford, Jr. | 222/401 X |

*Primary Examiner*—Kevin P. Shaver
*Assistant Examiner*—Joseph A. Kaufman

[57] ABSTRACT

An aerosol type container that can be repressurized with compressed air. The compressor is embodied in the repressurizing cap. The compressor works when the cap is rotated in a circular motion on top of the container. The compressor is a vane type, compressing air to repressurize the container, which is used to disperse the contents when needed. Once the container is pressurized the contents may be applied by a spray valve. The repressurizing cap can be removed from the container by a simple locking mechanism; a locking slide bar that moves in and out of a locking groove located on the container.

3 Claims, 3 Drawing Sheets

AEROSOL TYPE CONTAINER

DESCRIPTION OF THE PREFERRED EMBODIMENTS

Figure 1:
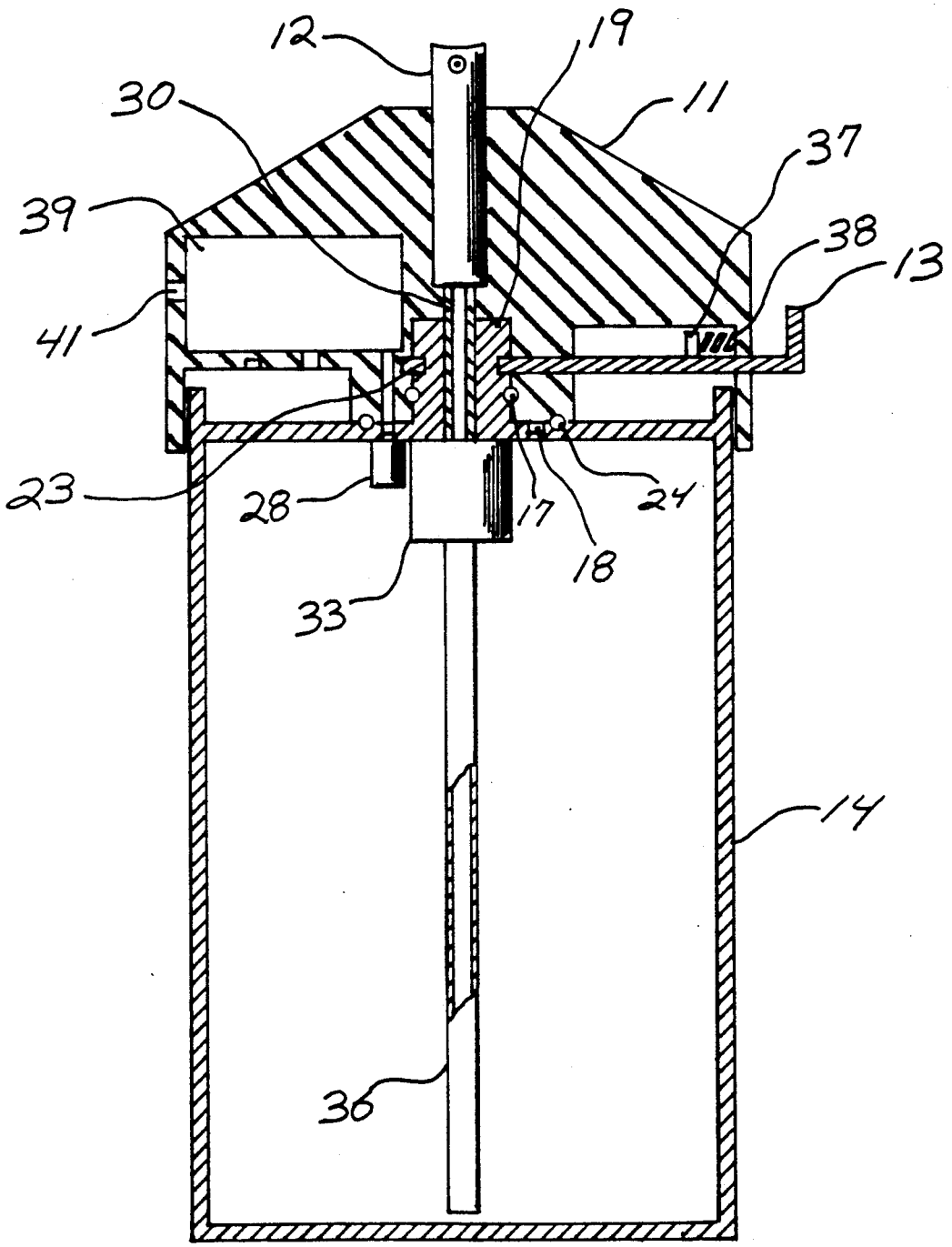
FIG. 1 is vertical sectional view.

Referring now to the drawings in FIG. 1 an aerosol type container designed specifically for this invention, the repressurizing cap 11 includes compressor cavity 39 with compressor assembly removed, air intake 41. The spray valve 12 projecting longitudinally downward through repressurizing cap 11 forming a seal with plunger 30. There are means for locking repressurizing cap 11 onto container 14 when locking slide bar 13 engages with locking groove 23, located on container boss 19. A seal is then formed with cap O-ring 17 and container O-ring 24, so that compressed air may not escape from air channel 18. The inside of container 14 includes a one-way pressure valve 28 and plunger housing 33 connected to the lower end thereof siphon tube 36 extending downward to the bottom of the container 14.

Figure 2:
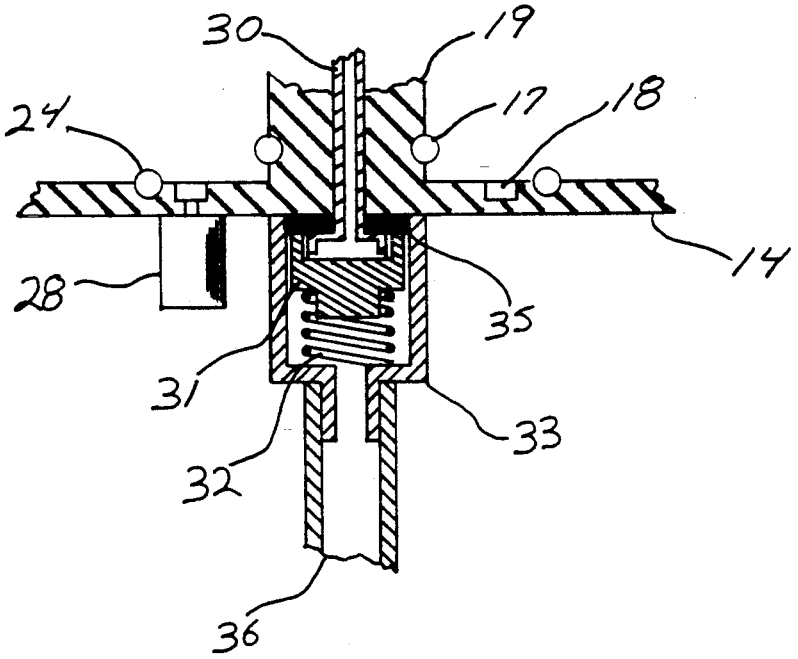
FIG. 2 is an enlarged fragmentary sectional view of the plunger housing assembly.

More specifically as shown in FIG. 2 the plunger housing 33 includes a plunger spring 32 that applies pressure to plunger valve 31 forming a seal with rubber seal 35. Plunger valve 31 carries the plunger 30, which engages with spray valve 12 (shown in FIG. 1). When depressed, plunger valve 31 opens allowing contents to be dispersed.

Figure 3:
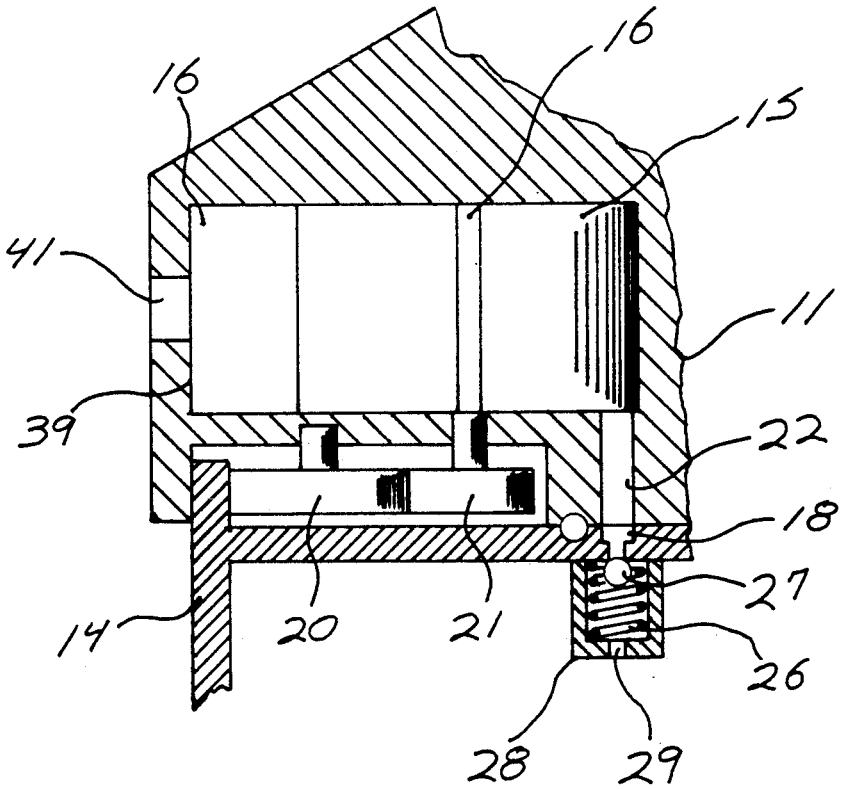
FIG. 3 is an enlarged fragmentary sectional view of the compressor assembly.

The one-way pressure valve 28 illustrated in FIG. 3 includes valve outlet 29, valve spring 26, applies pressure to valve ball 27 closing compressor outled 22, allowing compressed air into container 14 and preventing contents from escaping.

Figure 4:
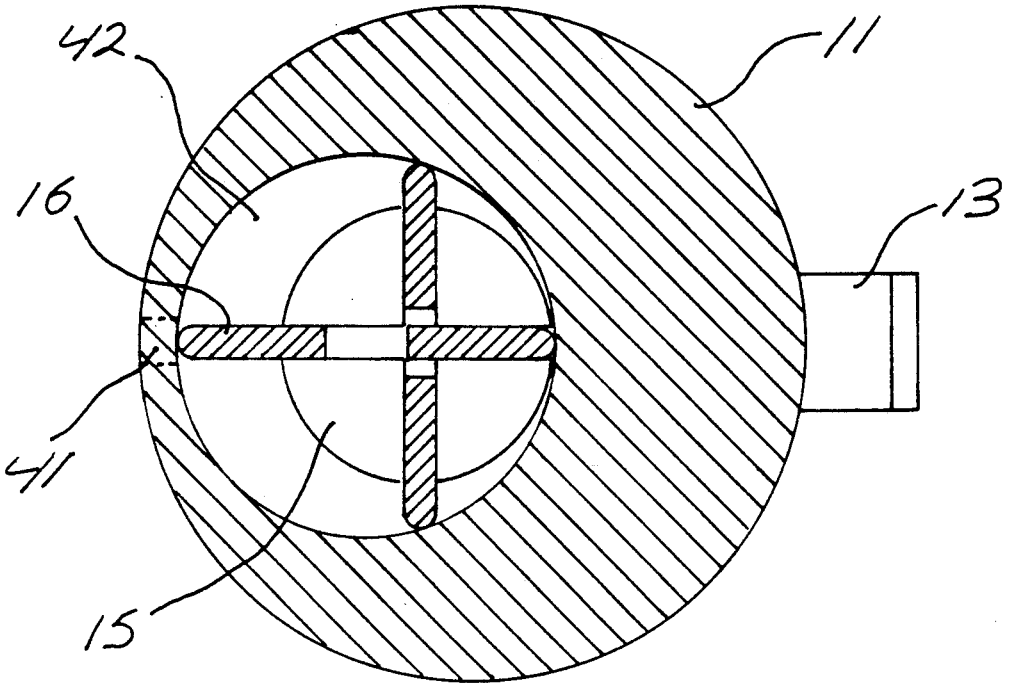
FIG. 4 is an enlarged plan sectional view of the compressor assembly.

Illustrated in FIGS. 3 and 4 the compressor assembly includes drive shaft 21 driven by drive wheel 20. When rotated, compressor body 15 is positioned off center of compressor cavity 39 so that compressor vanes 16 may extend outward forming compression chamber 42. Receiving air from air intake 41, compression chamber 42 is then rotated producing an increase in pressure. This compressed air is released into container 14 through an air passage which includes compressor outlet 22, air channel 18 and one-way pressure valve 28.

Figure 5:
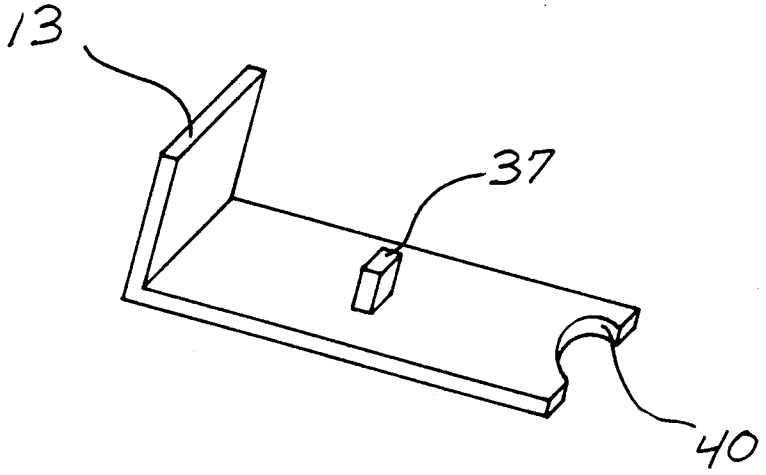
FIG. 5 is an isometric view of the locking slide bar.

Referring now to FIG. 5 the locking slide bar 13 includes a tab at one end spring post 37 that locates lock spring 38 (shown in FIG. 1) so that pressure is applied to repressurizing cap 11, forcing half circle lock 40 into lock position with locking groove 23 (shown in FIG. 1).

I claim:

1. An aerosol container comprising: a container having an open end and a closed end; a cap rotatably mounted on the open end of said container; a compressor intergral with said cap for repressurizing the container; said compressor forcing air into the container upon rotation of the cap; and the cap further comprising a spray valve for dispersing the pressurized contents of the container.

2. The aerosol container as in claim 1 further comprising: a locking slide bar having a tab on one end and a half-circle lock on the other end; a locking groove in the container; the half-circle lock engaging the container in said locking groove for preventing removal of the cap while the lock is engaged and allowing for removal of the cap upon disengagement of the locking bar from the groove, the tab allowing manual removal and insertion of the locking slide bar into and out of the groove.

3. The aerosol container as in claim 1 further comprising a one-way pressure valve in the container in communication with the compressor, said one-way pressure valve allowing pressurization of the container while preventing the contents of the container from escaping except through said spray valve.

* * * * *